US007611144B2

(12) United States Patent
Kusaka

(10) Patent No.: US 7,611,144 B2
(45) Date of Patent: Nov. 3, 2009

(54) GUIDE DEVICE FOR SHEET

(75) Inventor: Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 190 days.

(21) Appl. No.: 10/866,660

(22) Filed: Jun. 15, 2004

(65) Prior Publication Data

US 2005/0006840 A1 Jan. 13, 2005

(30) Foreign Application Priority Data

Jun. 19, 2003 (JP) ..... 2003-174551

(51) Int. Cl.
*B65H 39/10* (2006.01)

(52) U.S. Cl. ..... 271/290

(58) Field of Classification Search ..... 271/289, 271/290, 298, 299, 300, 303
See application file for complete search history.

(56) References Cited

U.S. PATENT DOCUMENTS

| | | | | |
|---|---|---|---|---|
| 1,607,143 | A * | 11/1926 | White | 101/183 |
| 3,106,393 | A * | 10/1963 | Koch | 271/279 |
| 2002/0088742 | A1 * | 7/2002 | Wursthorn | 209/552 |

FOREIGN PATENT DOCUMENTS

| | | | |
|---|---|---|---|
| DE | 298 05 409 | U1 | 7/1998 |
| DE | 198 19 490 | C1 | 10/1999 |
| DE | 101 07 953 | A1 | 8/2002 |
| GB | 2 340 827 | A | 3/2000 |
| JP | 63-8682 | Y2 | 3/1988 |
| JP | 64-014764 | | 1/1989 |
| JP | 64-021165 | | 2/1989 |
| JP | 05-032356 | | 4/1993 |
| JP | 06-144682 | | 5/1994 |
| JP | 6144682 | | 5/1994 |
| JP | 2576854 | Y2 | 5/1998 |
| JP | 2588807 | Y2 | 11/1998 |
| JP | 11-334036 | A | 12/1999 |
| JP | 2005-008355 | | 1/2005 |

* cited by examiner

*Primary Examiner*—Patrick H Mackey
*Assistant Examiner*—Thomas A. Morrison
(74) *Attorney, Agent, or Firm*—Birch, Stewart, Kolasch & Birch, LLP

(57) ABSTRACT

A sheet guide device has: a delivery chain for holding and transporting a sheet; first and second piles for piling the sheets transported by the delivery chain; a sheet release mechanism for switching between a first state, where the sheet held by the delivery chain is delivered to the first pile, and a second state, where the sheet held by the delivery chain is passed above the first pile and transported downstream in a sheet transport direction; and a guide rail which, in the second state, stretches out to above the first pile by an air cylinder to guide the sheet being passed. A wire moving between a guide position, where the wire guides the sheet between the first and second piles, and a retreat position, where the wire has receded from the guide position, is included. In the second state, the wire has moved to the guide position.

31 Claims, 9 Drawing Sheets

GUIDE DEVICE FOR SHEET

The entire disclosure of Japanese Patent Application No. 2003-174551 filed on Jun. 19, 2003, including specification, claims, drawings and summary, is incorporated herein by reference in its entirety.

BACKGROUND OF THE INVENTION

1. Field of the Invention

This invention relates to a guide device preferred for application to a delivery device for delivering sheets, which have been transported after being printed in a sheet-fed press, by transferring the sheets to a plurality of piling devices arranged in parallel in a sheet transport direction.

2. Description of the Related Art

In a sheet-fed press, a sheet printed by a printing apparatus is transferred from a gripper of a printing cylinder to a delivery gripper of a delivery chain, and is transported as the delivery chain runs. Then, the sheet is released from the delivery gripper above a pile board, and dropped onto the pile board for piling.

A conventional delivery device will be described based on FIGS. 8 and 9 (see Japanese Utility Model Registration No. 2588807). FIG. 8 is a schematic configuration drawing of a conventional delivery device, and FIG. 9 is a plan view of a sheet guide device.

As shown in FIG. 8, a delivery cylinder 3 is provided in opposed relationship with an impression cylinder 2 of a printing apparatus 1. A delivery chain 6 is looped between the delivery cylinder 3 and a sprocket 5 located in a rear portion of a delivery device 4. Many delivery grippers 7 are provided in the delivery chain 6, and printed sheets 8 are transferred from the delivery cylinder 3 to the delivery grippers 7, whereafter the printed sheets 8 are transported, while gripped by the delivery grippers 7, as the delivery chain 6 runs.

In the delivery device 4, two piling devices 9 and 10 (first pile 9, second pile 10) are installed in parallel in the transport direction of the sheet 8. The sheet 8 is released from the delivery gripper 7 above the first pile 9 or the second pile 10, and dropped onto the first pile 9 or the second pile 10 for piling.

A sheet lay 11 is provided on a downstream side of each of the first pile 9 and the second pile 10 in the direction of sheet transport. The front end of the sheet 8, released from the delivery gripper 7, contacts the sheet lay 11 to become positioned in the direction of sheet transport, and the sheet 8 comes to a stop. A suction wheel 12 is provided on an upstream side of each of the first pile 9 and the second pile 10 in the direction of sheet transport to be movable in the direction of sheet transport. The rear end of the sheet 8, released from the delivery gripper 7, is sucked by the suction wheel 12. The sheet 8 is reduced in speed under this sucking action, so that shock upon its contact with the sheet lay 11 is absorbed.

A sheet guide device 13 is provided beside the sheet lay 11 of the first pile 9, and the sheet guide device 13 is adapted to cover the upper surface of the first pile 9 from a downstream side toward an upstream side in the direction of sheet transport.

The sheet guide device 13 will be described based on FIG. 9. A sheet lay shaft 15 is supported rotatably between right and left frames 14 of the delivery device 4. A plurality of (five in the illustrated embodiment) the aforementioned sheet lays 11 are mounted on the sheet lay shaft 15, and the five sheet lays 11 are simultaneously erected by rotation of the sheet lay shaft 15.

Right and left paired guides 16 extending in the direction of sheet transport are mounted on the frames 14, and a base 17 extending parallel to the sheet lay shaft 15 is supported between these guides 16 to be movable in the direction of sheet transport. Sheet bearers 19 with rollers are mounted on the base 17 via a plurality of (nine in the illustrated embodiment) support plates 18, and the sheet bearers 19 extend upstream from the base 17 in the direction of sheet transport.

A stationary base 20 is installed, parallel to the above-mentioned base 17, between end portions of the guides 16 on a downstream side in the direction of sheet transport. A moving mechanism 24 of a parallel ruler type, which consists of an X-link 21, an air cylinder 22, and slots 23*a* to 23*d*, is interposed between the stationary base 20 and the base 17. Thus, the base 17 makes a reciprocating motion in the direction of sheet transport under the expanding and contracting action of the air cylinder 22, whereby the sheet bearers 19 become movable between a guide position (the state of solid lines in FIG. 9), where the sheet bearers 19 cover the upper surface of the first pile 9 on the downstream side in the direction of sheet transport, and a retreat position (see double-dotted chain lines in FIG. 9), where the sheet bearers 19 expose this upper surface.

According to the delivery device 4 with the above features, the sheets 8, which have been printed by the printing apparatus 1 and transported to the delivery device 4 by the delivery chain 6, are delivered to the first pile 9 and the second pile 10 switched alternately. Hence, the printing press can be continuously operated without being shut down, thereby achieving improved productivity. Since the first pile 9 and the second pile 10 are provided, moreover, defective sheets can be detected by a defective sheet detector (not shown), and only the defective sheets can be delivered to the second pile 10. Alternatively, only arbitrary sheets 8, which are to be inspected, for example, by inspection of printing, can be with drawn to the second pile 10. Further alternatively, if one of the first pile 9 and the second pile 10 is full of the sheets 8, this full pile can be switched to the other pile, and the sheets 8 filling up the one pile can be discharged.

In the above-described delivery device 4 having the first pile 9 and the second pile 10 arranged side by side in the direction of transport of the sheet 8, when the sheet 8 is to be delivered to the second pile 10, the sheet 8 gripped by the delivery gripper 7 passes above the first pile 9, but a rear end portion of the sheet 8 is free and flutters or moves unstably. On this occasion, the sheet bearers 19 are moved to the guide position where the sheet bearers 19 cover the upper surface of a downstream side to an upstream side of the first pile 9 in the direction of sheet transport, whereby the fluttering or instability of the sheet can be prevented to minimize a decline in printing quality or the like.

With the foregoing conventional delivery device 4, however, when the sheet bearers 19 located at the retreat position (the position between the piles) are moved to the guide position, no guide member is present at the retreat position (the position between the piles). In addition, the distance between the piles, over which no guide member is existent, increases because the suction wheel 12 moves from the upstream side to the downstream side in the direction of sheet transport. This causes 8 occurs between the piles. In brief, the sheet bearers 19 alone are not enough to prevent the fluttering or instability of the sheet 8.

In guiding the sheet 8, moreover, if opposite end portions, in particular, of the sheet 8 in its width direction are not supported, these opposite end portions droop. However, the sheet bearers 19 of the sheet guide device 13 cannot be position-adjusted in the lateral direction (the direction perpendicular to the direction of sheet transport). Thus, in the case of a change in the sheet size (the size in the width direction), for example, there is the problem that the opposite end portions of the sheet cannot be guided unerringly.

In addition, since the sheet bearers 19 cannot be position-adjusted in the width direction of the sheet 8, a side jogger (not shown) interferes with the sheet bearer 19, in the case of a change in the sheet size (for example, a change from a large size to a small size in the width direction) . Thus, the sheet bearers 19 on the right-hand and left-hand sides need to be removed from the support plates 18. At this time, bolts are detached by use of a tool, thus requiring that the printing press be shut down, the sheets 8 be pulled out of the first pile 9 to secure a work space, and removal work be done. This results in a low work efficiency. In a printing machine equipped with an automated device, such as a sheet size preset device, the sheet size is changed with the touch of a button. With such a machine, if the above-mentioned work fails to be performed, a trouble occurs, such as an operational failure or a damage to a component.

Besides, when the aforementioned delivery device 4 is to be applied to a perfecting printing press or a printing press in which sheet is transported with its printed surface directed downward, printed areas of the back of the sheet 8 may contact the sheet bearer 19 or the like to stain the printed surface by rubbing. To prevent this event, the sheet bearer 19 should be moved to a position where the sheet bearers 19 guide the non-printed areas (the margins) of the sheet 8. However, the sheet bearers 19 cannot be position-adjusted in the width direction of the sheet 8, and thus cannot be moved to that position. Hence, the delivery device 4 cannot be applied to such a printing press.

SUMMARY OF THE INVENTION

The present invention has been accomplished in the light of the circumstances stated above. The object of the invention is, therefore, to provide a guide device for a sheet, which can effectively guide the sheet not only above a pile but also between piles to prevent fluttering or instability of the sheet, thereby achieving an improvement in printing quality.

To attain the above object, the present invention provides a guide device for a sheet, comprising: transport means for holding and transporting the sheet; a first piling device and a second piling device for piling the sheet transported by the transport means; switching means for switching between a first state, where the sheet held by the transport means is delivered to the first piling device, and a second state, where the sheet held by the transport means is passed above the first piling device and transported to a downstream side in a sheet transport direction; and first guide means which, when in the second state, stretches out toward a side above the first piling device under an action of drive means to guide the sheet being passed, and the guide device further comprising second guide means adapted to move between a guide position, at which the second guide means guides the sheet between the first piling device and the second piling device, and a retreat position, at which the second guide means has receded from the guide position, and wherein when in the second state, the second guide means has moved to the guide position.

The guide device, constituted as described above, can effectively guide the sheet not only above the first piling device, but also between the first piling device and the second piling device, thus reliably preventing the fluttering and instability of the sheet, and achieving improved printing quality.

One end side of the second guide means may be urged in the direction of the retreat position, the other end side of the second guide means may be supported by the first guide means, and the second guide means may be moved together with the first guide means by the drive means.

A plurality of guide means, each composed of the first guide means supported on a first bracket and the second guide means supported on a second bracket supporting a position restraint member, may be provided in the width direction of the sheet.

According to the above-mentioned feature, the position restraint member may be a suction wheel capable of sucking the sheet.

The guide device may include a position restraint member provided beside the second piling device and supported to be movable in the sheet transport direction in accordance with the size of the sheet, and the second guide means may be supported via the position restraint member.

According to the above-mentioned feature, the position restraint member may be a suction wheel capable of sucking the sheet.

A plurality of the first guide means and the drive means may be provided in the width direction of the sheet, and control means may be provided for making the drive means inoperable in accordance with the width of the sheet to be transported.

The first and second guide means may have adjusting means for making adjustment in the width direction of the sheet.

The first guide means may be supported on each of a plurality of first brackets provided in parallel in the width direction of the sheet, the first brackets may be supported to be movable in the width direction of the sheet on stays spanning frames, a plurality of threaded bars may pierce through the first brackets, and in accordance with the rotation of predetermined threaded bars of the plurality of threaded bars, predetermined first brackets screwed to the predetermined threaded bars among the first brackets can be moved, singly or in combination synchronously, in the width direction of the sheet.

The second guide means may be supported on each of a plurality of second brackets provided in parallel in the width direction of the sheet for supporting a position restraint member, the second brackets may be supported to be movable in the width direction of the sheet on a support shaft which spans frames and which is movable in the sheet transport direction, a plurality of threaded bars may pierce through the second brackets, and in accordance with the rotation of predetermined threaded bars of the plurality of threaded bars, predetermined second brackets screwed to the predetermined threaded bars among the second brackets can be moved, singly or in combination synchronously, in the width direction of the sheet.

According to the above-described feature, the position restraint member may be a suction wheel capable of sucking the sheet.

The first guide means and the second guide means may be located on nearly a same plane.

The second guide means may be a wire.

The wire may be urged in the retreat direction by a drum rotationally urged in one direction by urging means.

One end side of the wire may be anchored to a weight.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A guide device for a sheet according to the present invention will now be described in detail by embodiments with reference to the accompanying drawings, which in no way limit the invention.

First Embodiment

Figure 1:
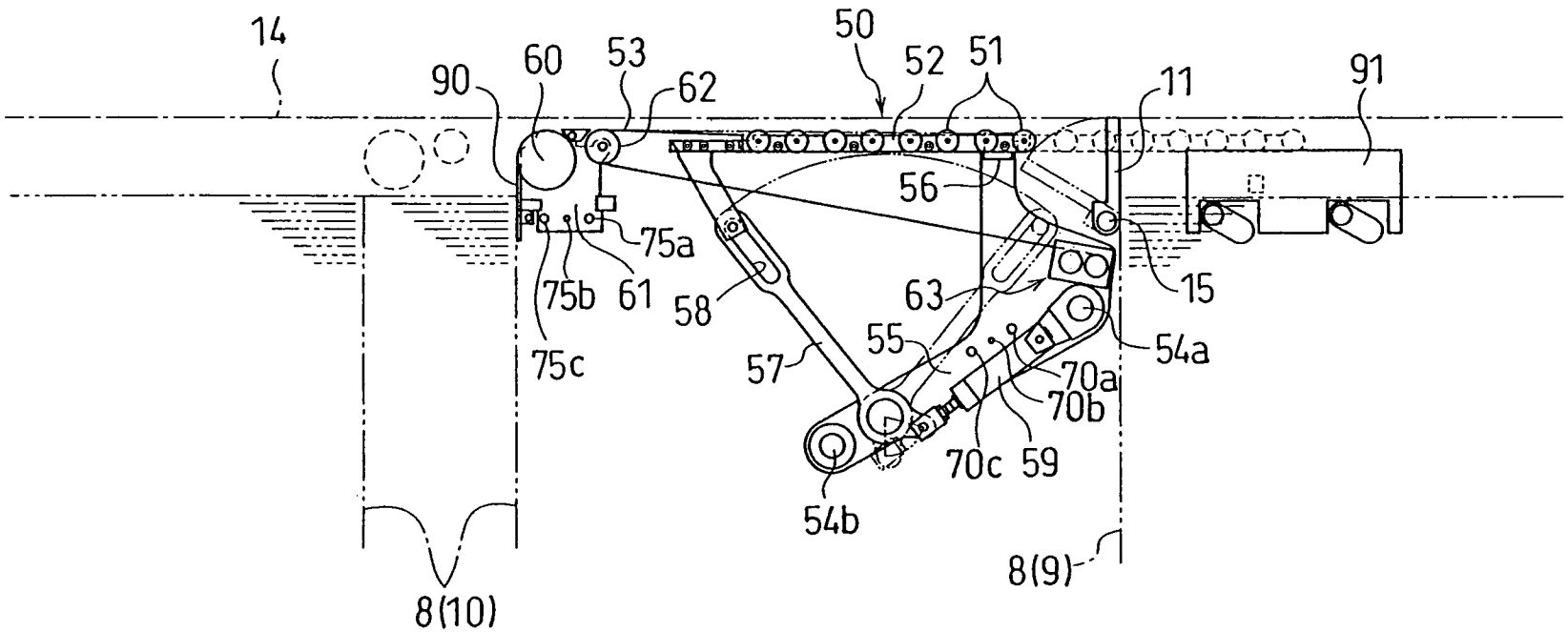
FIG. 1 is a side view of a sheet guide device showing a first embodiment of the present invention.
Figure 2:
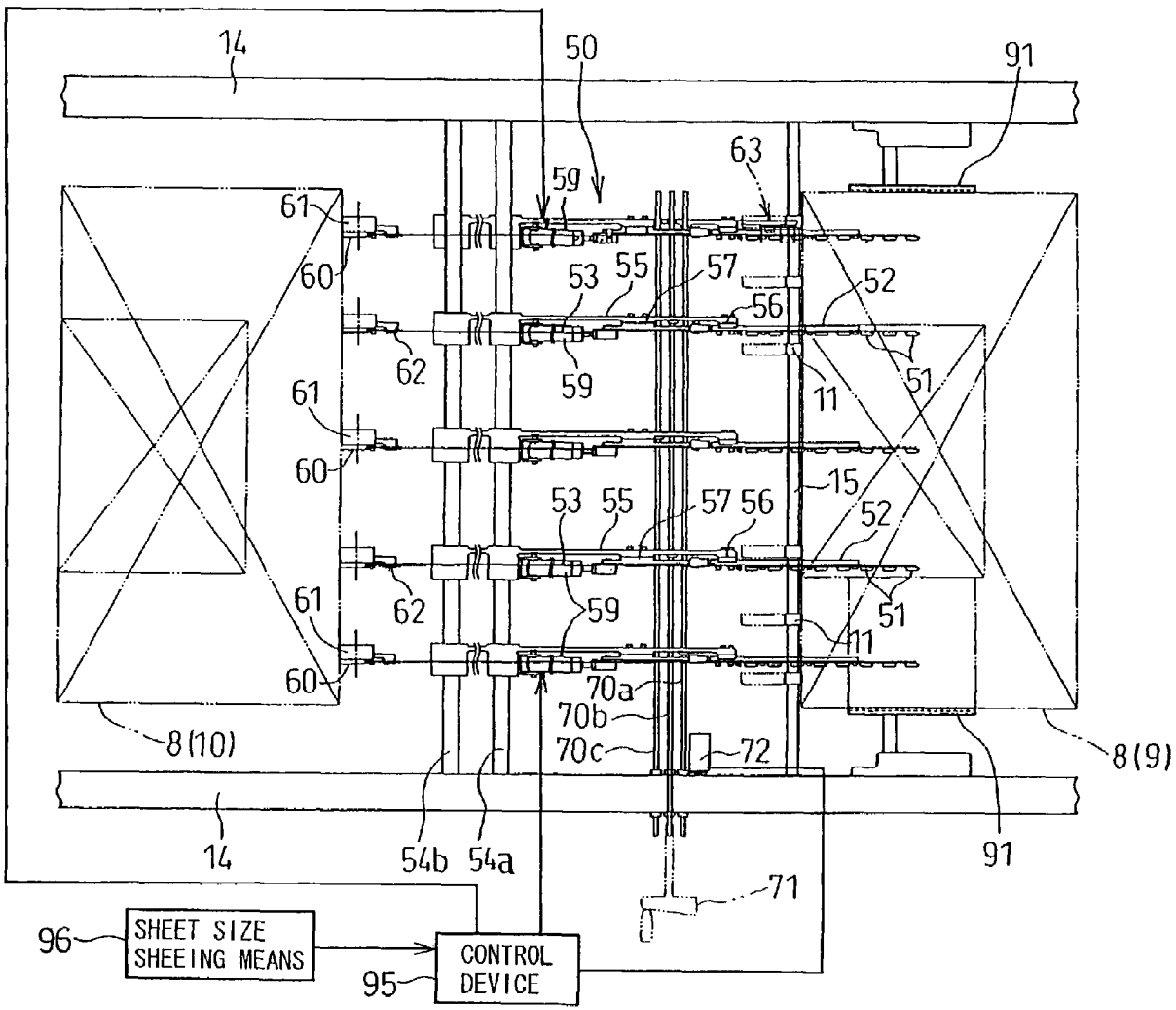
FIG. 2 is a plan view of the guide device.
Figure 3:
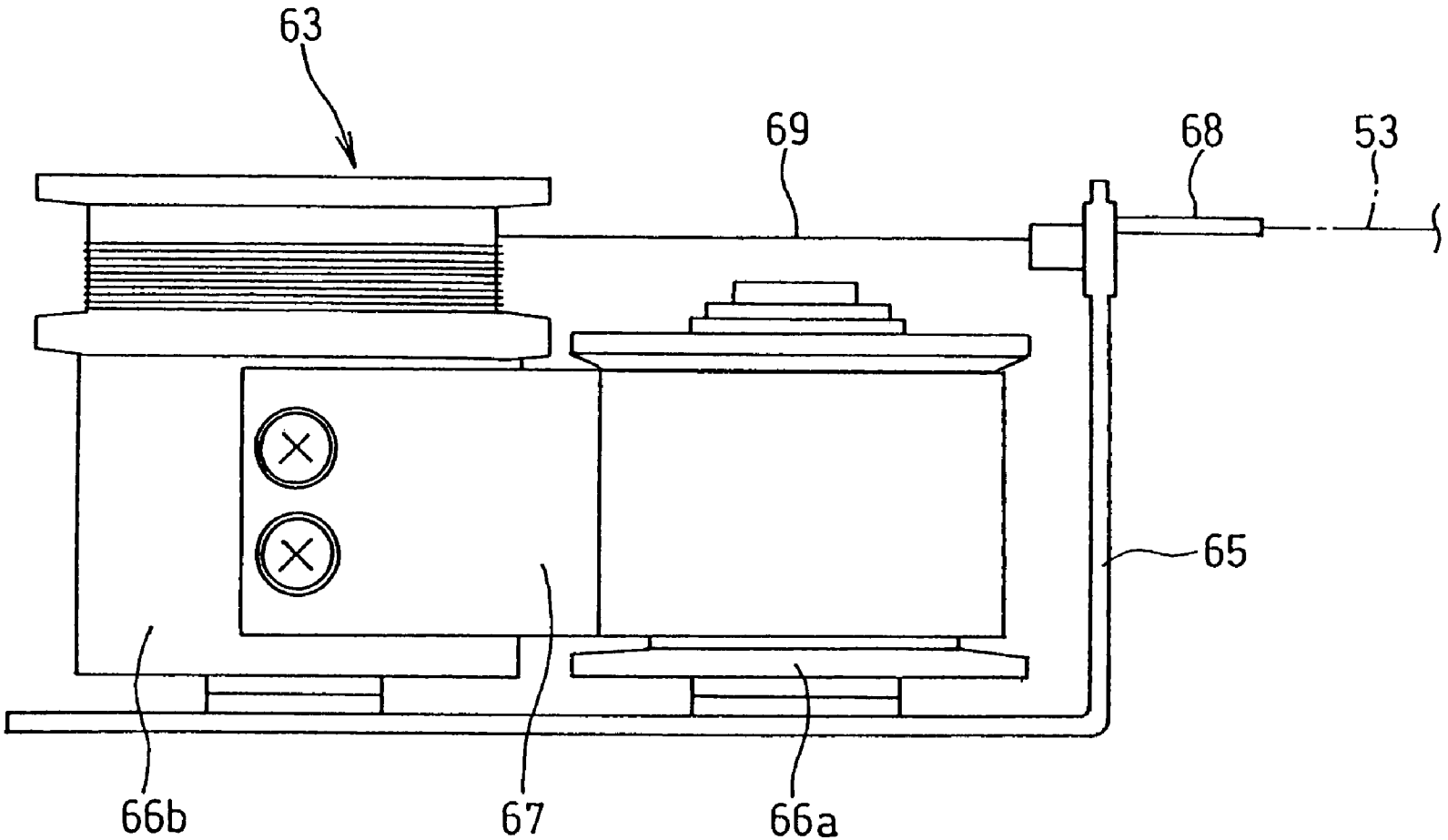
FIG. 3 is a side view of a wire unit.
Figure 4:
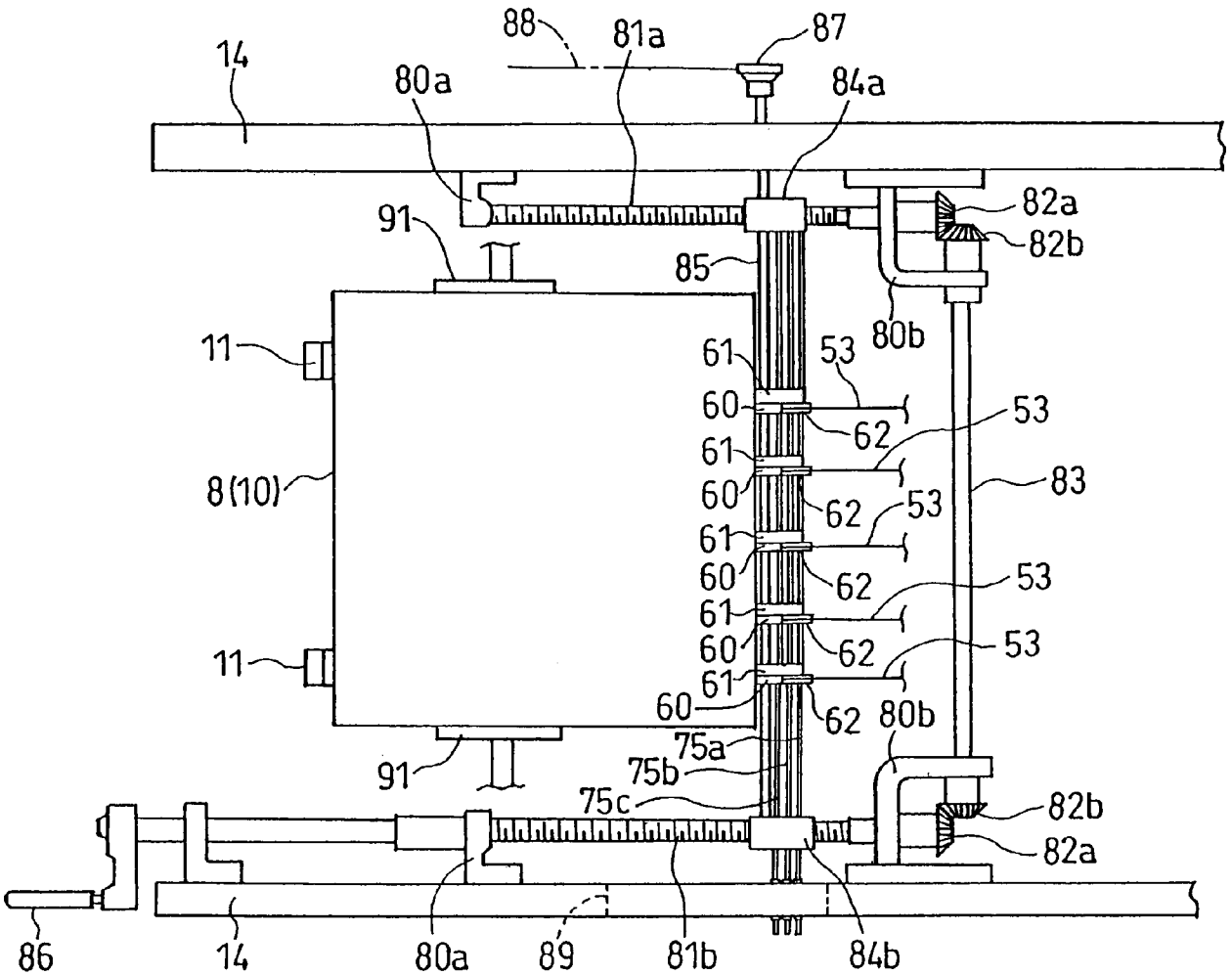
FIG. 4 is a plan view of a moving mechanism for a suction wheel.
Figure 5:
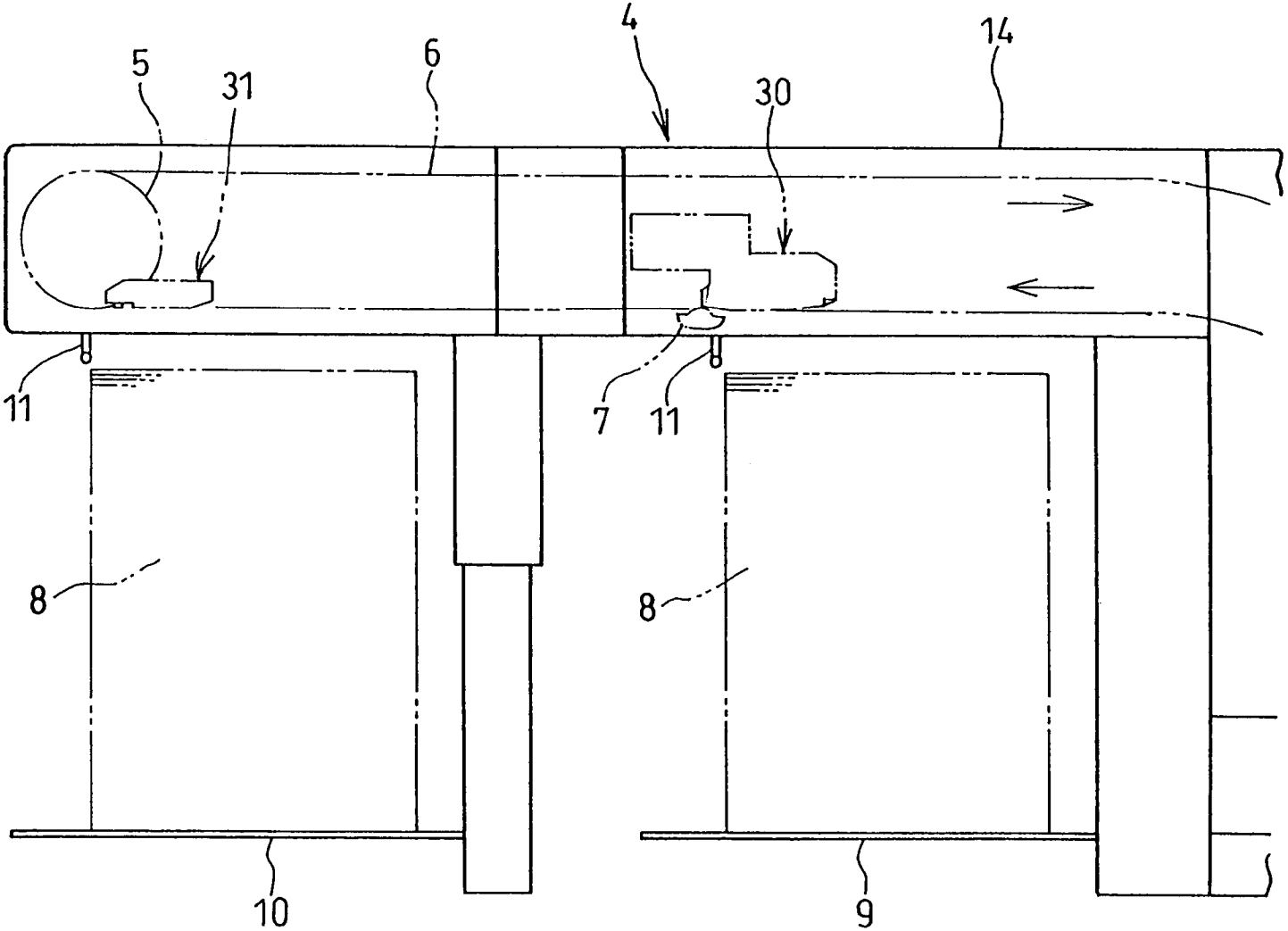
FIG. 5 is a side view of a delivery device of a sheet-fed press.
Figure 6:
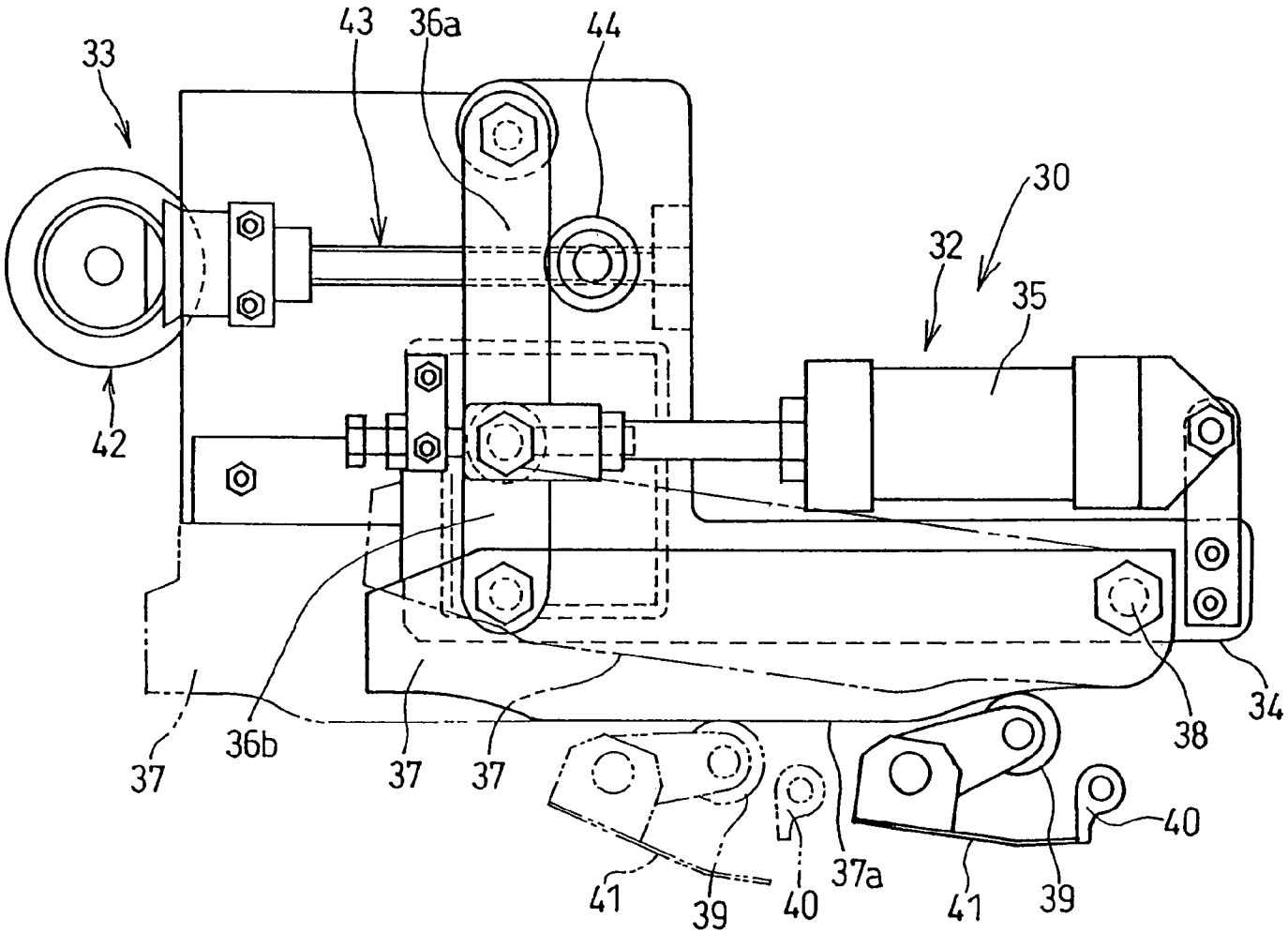
FIG. 6 is a detail view of a sheet release mechanism.
Figure 8:
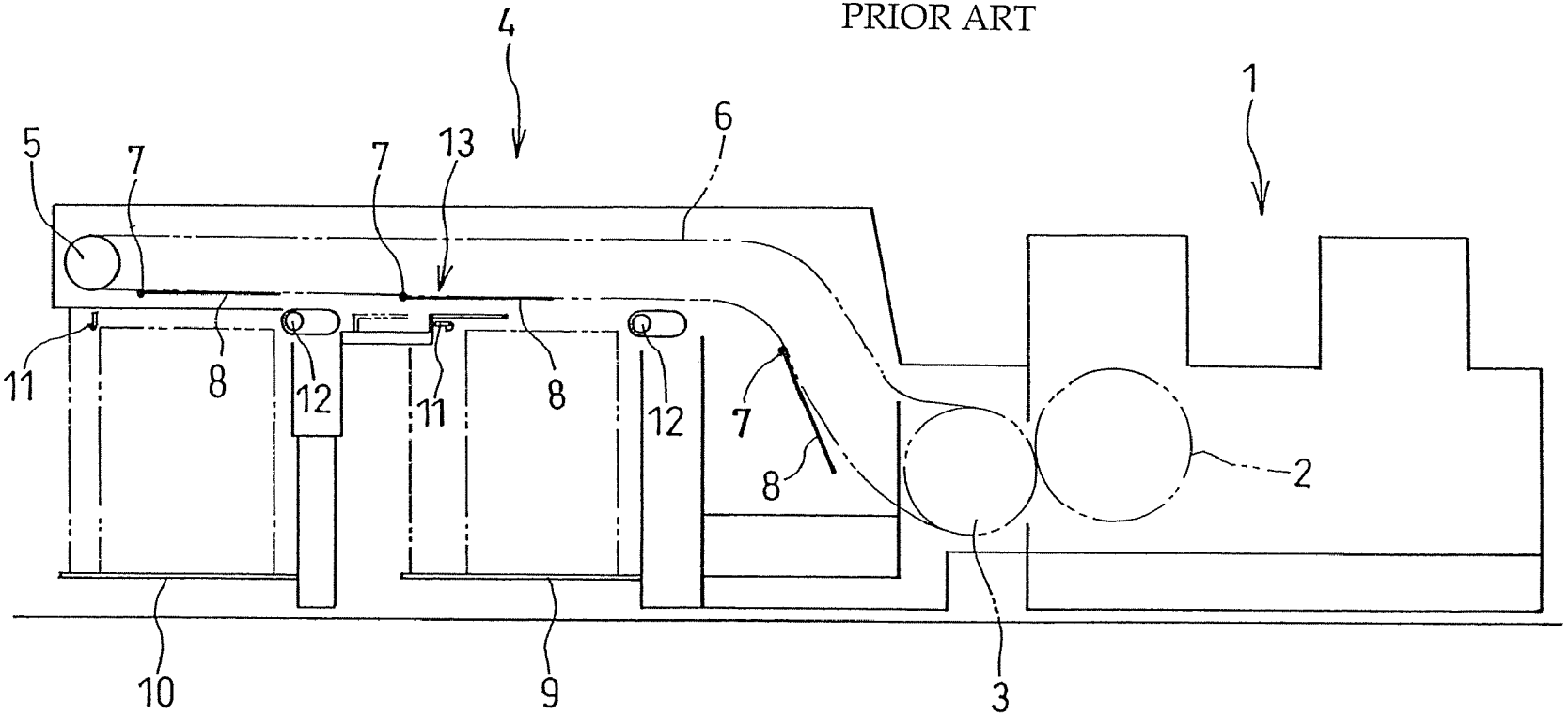
Fig.8 PRIOR ART
FIG. 8 is a schematic configuration drawing of a conventional delivery device.
Figure 9:
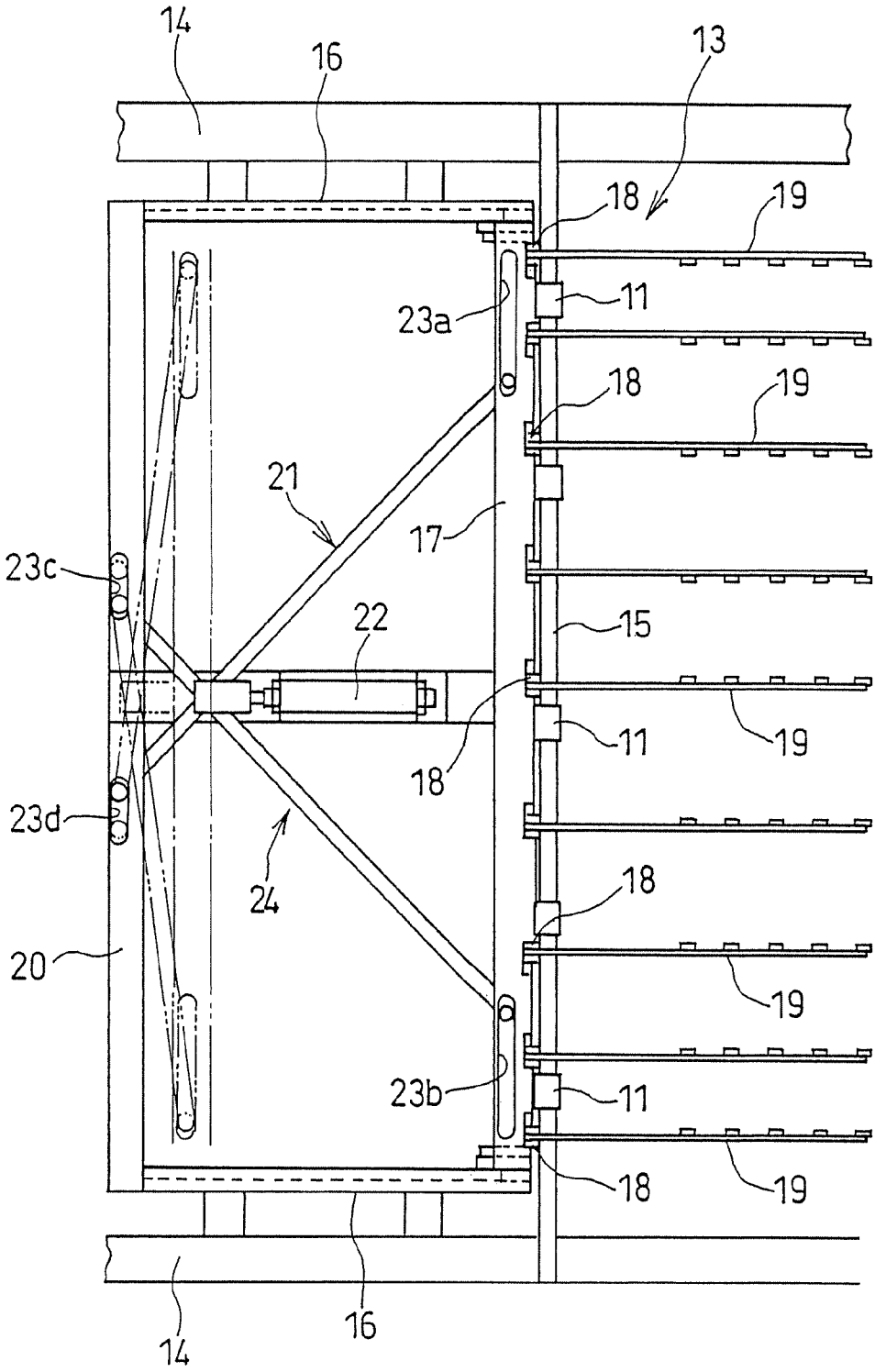
Fig.9 PRIOR ART
FIG. 9 is a plan view of a sheet guide device in the conventional delivery device.

FIG. 1 is a side view of a sheet guide device showing a first embodiment of the present invention. FIG. 2 is a plan view of the guide device. FIG. 3 is a side view of a wire unit. FIG. 4 is a plan view of a moving mechanism for a suction wheel. FIG. 5 is a side view of a delivery device of a sheet-fed press. FIG. 6 is a detail view of a sheet release mechanism. In these drawings, the same members as the members shown in FIGS. 8 and 9 are assigned the same numerals as used therein, and duplicate explanations are omitted.

As shown in FIG. 5, a delivery device 4 has two piling devices 9 and 10 (first pile 9, second pile 10) provided in parallel in the direction of transport of a sheet 8. The sheet 8 is transported while being held by a delivery gripper 7 of a delivery chain (transport means) 6. The sheet 8 is released from the delivery gripper 7 above the first pile 9 or the second pile 10 by a sheet release mechanism 30 or 31 (to be described later), and dropped onto the first pile 9 or the second pile 10 for piling.

A sheet lay 11 is provided on a downstream side of the first pile 9 or the second pile 10 in the direction of sheet transport. The front end of the sheet 8, released from the delivery gripper 7, contacts the sheet lay 11 to become positioned in the direction of sheet transport and come to a halt. A suction wheel 60 (see FIGS. 1, 2 and 4) , as a position restraint member (to be described later), is provided upstream from the first pile 9 or the second pile 10 in the direction of sheet transport. The rear end of the sheet 8, released from the delivery gripper 7, is sucked by the suction wheel 60. The sheet 8 is reduced in speed under this sucking action, so that shock upon its contact with the sheet lay 11 is absorbed.

As shown in FIG. 6, the sheet release mechanism (switching means) 30 for the first pile 9 is generally composed of cam switching means 32 and cam moving means 33. In the cam switching means 32, an air cylinder 35 supported by a base plate 34 expands, whereby two levers, i.e., an upper lever 36*a* and a lower lever 36*b*, connected to the front end of a piston rod of the air cylinder 35 are brought into a linear form. As a result, a swing cam 37 is rotated counterclockwise about a pivot point 38 and moved to a sheet release position (see solid lines in the drawing) . By this action, a cam follower 39 of the delivery gripper 7 makes rolling contact with a cam surface 37*a* of the swing cam 37 to separate a gripper 41 from a gripper pad 40, thus releasing the sheet 8. By contrast, the air cylinder 35 contracts, whereby the two levers, upper lever 36*a* and lower lever 36*b*, are brought into a mountain-shaped form topped by the front end of the piston rod. Thus, the swing cam 37 is rotated clockwise about the pivot point 38 and moved to a retreat position (see double-dotted chain lines in the drawing).

In the cam moving means 33, rotations of a motor (not shown) are transmitted to a ball screw mechanism 43, which is supported on the inner surface of a frame 14 (see FIG. 5), via a gear mechanism 42. As a result, the aforementioned base plate 34 supported by a nut member 44 of the ball screw mechanism 43 is moved in the direction of sheet transport, whereby the swing cam 37 can be position-adjusted in the direction of sheet transport in accordance with, for example, a change in the size (in the length direction) of the sheet 8.

The sheet release mechanism 31 for the second pile 10 is composed of a mere stationary cam (not shown), unlike the sheet release mechanism 30 for the first pile 9. Every time, the cam follower 39 of the delivery gripper 7 makes a rolling contact. If the sheet 8 is held by the delivery gripper 7 at the time of contact, the sheet 8 is released and dropped onto the second pile 10 for piling. The above-mentioned sheet release mechanisms (switching means) 30, 31 are already known to the public by Japanese Utility Model Registration No. 2576854 and, herein, will not be described in detail. For their detailed features, reference should be made to this publication.

As shown in FIGS. 1 and 2, a sheet guide device 50 is interposed between the first pile 9 and the second pile 10. This sheet guide device 50 has a guide rail (first guide means) 52 provided with a plurality of rollers 51 arranged in a longitudinal direction, and a wire (second guide means) 53 connected to the guide rail 52.

The guide rail 52 is supported by a bracket (first bracket) 55 which is movable, in the width direction (lateral direction) of the sheet 8, on two stay bars 54*a* and 54*b* spanning the right and left frames 14 and spaced by a predetermined distance in the direction of sheet transport. That is, the guide rail 52 is supported by a linear guide 56, which is annexed to a rear end side of the bracket 55, to be movable in the direction of sheet transport. One end of a bell crank 57, which is pivotally supported by a front end side of the bracket 55, is connected to a front end portion of the guide rail 52 via a slot 58. The front end of a piston rod of an air cylinder (drive means) 59 pivotally supported by a rear end side of the bracket 55 is pinned to the other end of the bell crank 57. When the air cylinder 59 expands from the state of FIG. 1, the bell crank 57 rotates clockwise to stretch out the guide rail 52 horizontally rearwardly in the direction of sheet transport, whereby the guide rail 52 is located above the first pile 9 to guide the sheet 8.

The wire 53 has one end engaged with a front end portion of the guide rail 52, and has the other end passed over a pulley 62 supported by a bracket (second bracket) 61 which supports the aforementioned suction wheel 60 for the second pile 10. Then, the other end of the wire 53 is anchored to a wire unit 63 annexed to a rear end side of the bracket 55, such that the wire 53 is always under tension by the wire unit 63. When the guide rail 52 is stretched out toward the upstream side in the direction of sheet transport, the wire 53 follows, and stretches out nearly horizontally and at nearly the same level as the guide rail 52, arriving at a guide position between the first pile 9 and the second pile 10 to guide the sheet 8 (see FIG. 2). Conversely, when the guide rail 52 is moved toward the downstream side in the direction of sheet transport, the wire 53 follows this movement, and is retracted to a retreat position receding from the guide position (see FIG. 1).

The wire unit 63, as shown in FIG. 3, is comprised of a pair of drums 66*a* and 66*b* rotatably supported on an L-bracket 65, a leaf spring (urging means) 67 wrapped around one of the drums, 66*a*, and having an unwound end fixed to the other drum 66*b*, and a wire 69 wound round the other drum 66*b* and having a paid-out end fixed to a terminal 68. Whatever position the terminal 68 is pulled out to, the pull-in force (return force) and pull-out force of the wire unit 63 are kept constant by the action of the leaf spring 67. The aforementioned wire 53 is connected to the terminal 68 of the wire unit 63.

The so configured guide rail 52 and wire 53 constitute a set, and a plurality of (five in the illustrated embodiment) the sets are disposed with predetermined spacing in the width direction of the sheet 8. Three threaded bars (first adjusting means) 70*a* to 70*c* pierce through the brackets 55 of the respective sets for the guide rails 52. In accordance with the rotation of predetermined threaded bars of these three threaded bars 70*a* to 70*c*, predetermined brackets screwed to the threaded bars among the brackets 55 of the respective set scan be moved, singly or in combination synchronously, in the width direction of the sheet 8.

In the illustrated embodiment, one end portions of the three threaded bars 70*a* to 70*c* pierce through the frame 14, and can each be operated by a removable handle 71. When the threaded bar 70*a* is rotated, the brackets 55 on the opposite sides, which are screwed differently to a right-hand thread portion and a left-hand thread portion, respectively, of the threaded bar 70*a*, are moved in directions opposite to each other, whereby the positions of the guide rails 52 in the width direction of the sheet 8 (i.e., the lateral positions) are adjusted. When the threaded bar 70*b*is rotated, the two intermediate brackets 55, which are screwed differently to a right-hand thread portion and a left-hand thread portion, respectively, of the threaded bar 70*b*, are moved in directions opposite to each other, whereby the lateral positions of the guide rails 52 are adjusted. When the threaded bar 70*c* is rotated, the central bracket 55, which is screwed to the threaded bar 70*c*, is moved in a predetermined direction, whereby the lateral position of the guide rail 52 is adjusted.

The lateral positions of the brackets 55 (guide rails 52) on the opposite sides are detected by a rotary encoder 72, whose detection signals are input to a control device (control means) 95 such as a microcomputer. The control device 95 receives sheet size data, used for next printing, from sheet size setting means 96. Based on the inputted sheet size data and the detection signals from the rotary encoder 72, the control device 95 determines whether the air cylinders 59 on the opposite sides should act or not, and exercises control accordingly.

In tune with the adjustment of the lateral positions of the guide rails 52, the wires 53 also have their positions in the width direction of the sheet 8 (i.e., their lateral positions) adjusted. That is, three threaded bars (second adjusting means) 75*a* to 75*c* pierce through the brackets 61 of the respective sets for the wires 53. In accordance with the rotation of predetermined threaded bars of these three threaded bars 75*a* to 75*c*, predetermined brackets screwed to the threaded bars among the brackets 61 of the respective sets can be moved, singly or in combination synchronously, in the width direction of the sheet 8 (see FIG. 4). In detail, one end portions of the three threaded bars 75*a* to 75*c* pierce through a bearing nut 84*b* (to be described later) and the frame 14, and can each be operated by the removable handle 71 (see FIG. 2). When the threaded bar 75*a* is rotated, the brackets 61 on the opposite sides, which are screwed differently to a right-hand thread portion and a left-hand thread portion, respectively, of the threaded bar 75*a*, are moved in directions opposite to each other, whereby the positions of the pulleys 62 and the suction wheels 60 in the width direction of the sheet 8 (i.e. the lateral positions) are adjusted. When the threaded bar 75*b* is rotated, the two intermediate brackets 61, which are screwed differently to a right-hand thread portion and a left-hand thread portion, respectively, of the threaded bar 75*b*, are moved in directions opposite to each other, whereby the lateral positions of the pulleys 62 and the suction wheels 60 are adjusted. When the threaded bar 75*c* is rotated, the central bracket 61, which is screwed to the threaded bar 75*c*, is moved in a predetermined direction, whereby the lateral position of the pulley 62 and the suction wheel 60 is adjusted.

The pulley 62 passed over by the wire 53, and the suction wheel 60 also have their positions in the direction of sheet transport (their longitudinal positions) adjustable in response to a change in the size (lengthwise size) of the sheet 8 by way of the bracket 61 supporting the pulley 62 and the suction wheel 60.

That is, as shown in FIG. 4, right and left paired threaded shafts 81*a* and 81*b* are supported on the inner surfaces of the right and left frames 14 via bearings 80*a* and 80*b* to be immovable in the direction of sheet transport and be parallel to the frames 14. The rear ends of the threaded shafts 81*a* and 81*b* are connected together by a transmission shaft 83 via bevel gears 82*a* and 82*b*. Bearing nuts 84*a* and 84*b* are screwed to the threaded shafts 81*a* and 81*b* in phase with each other in the axial direction. A suction wheels haft 85 for suction wheel rotational driving, which supports the suction wheels 60 axially movably by spline engagement or the like, is journaled between the bearing nuts 84*a* and 84*b*. The aforementioned three threaded shafts 75*a* to 75*c* span the bearing nuts 84*a* and 84*b* to be rotatable and axially immovable.

Thus, by rotating one of the threaded shafts, 81*b*, using a handle 86, the bearing nuts 84*a* and 84*b* are moved on the threaded shafts 81*a* and 81*b* in the same direction and by the same distance in the direction of sheet transport, whereby the positions of the pulley 62 passed over by the wire 53 and the suction wheel 60 in the direction of sheet transport are adjusted. A chain 88 is looped between a sprocket 87, which is fixed by a shaft to a shaft end portion of the suction wheel shaft 85, and a sprocket on the drive side (not shown), whereby the suction wheel shaft 85 is adapted to be rotated in interlocked relationship with the drive side. A through-hole 89 of the frame 14, which the three threaded shafts 75*a* to 75*c* pierce through, is formed as a slot elongated in the direction of sheet transport. The above-mentioned longitudinal position adjustment mechanism for the suction wheel 60 is already known to the public by Japanese Utility Model Publication No. 1988-8682, and its detailed features are not described in detail herein by referring to this publication.

In FIG. 1, the numeral 90 denotes a sheet tail lay supported by the bracket 61, and numeral 91 in FIGS. 1, 2 and 4 denotes a side jogger for adjusting the lateral position of the sheet 8, for example, in the case of a change in the size (widthwise size) of the sheet 8.

Because of the above-described configuration, the sheet 8, which has been printed by a printing apparatus 1 (see FIG. 8) and transported by a delivery chain 6 to the delivery device 4, is released from the delivery gripper 7 by the sheet release mechanism 30 for the first pile 9 and dropped onto the first pile 9 for piling (a first state) , when the swing cam 37 of the cam switching means 32 is switched to the position where the swing cam 37 engages (makes rolling contact with) the cam follower 39 of the delivery gripper 7.

Conversely, when the swing cam 37 is switched to the position where the swing cam 37 does not engage the cam follower 39, the sheet 8 passes above the first pile 9 (a second state), and is dropped by the sheet release mechanism 31 for the second pile 10 onto the second pile 10 for piling.

At this time, the sheet guide device 50 interposed between the first pile 9 and the second pile 10 acts, so that the sheet 8 is guided above the first pile 9 by the guide rail 52 and is also guided above the space between the first pile 9 and the second pile 10 by the wire 53. That is, the air cylinder 59 expands, with the result that the guide rail 52 stretches out horizontally (see the double-dotted chain lines in FIG. 1) toward the upstream side in the direction of sheet transport in accordance with the clockwise rotation of the bell crank 57. Following (pulled by) this stretching-out action of the guide rail 52, the wire 53 extends out from the wire unit 63 nearly horizontally and at nearly the same level as the guide rail 52, and is put at the guide position between the first pile 9 and the second pile 10 (see FIG. 2).

During the stretching-out action of the guide rail 52, the sheet lay 11 is laid down (see double-dotted chain lines in FIGS. 1 and 2) by the rotation of the sheet lay shaft 15 in order to prevent interference between the guide rail 52 and the sheet lay 11 for the first pile 9.

By rotating the threaded bars 70*a* to 70*b* and 75*a* to 75*c*, the lateral positions of the guide rail 52 and the wire 53 are adjusted in accordance with the size (widthwise size) of the sheet 8. When the size (widthwise size) of the sheet 8 is changed, for example, the opposite end portions of the sheet 8 in its width direction are guided unerringly.

Depending on the size (widthwise size) of the sheet 8, the side joggers 91 for the first and second piles 9 and 10 are moved in the width direction of the sheet 8 by a motor or the like. On this occasion, the guide rails 52 on the opposite sides need not be stretched out by keeping the corresponding air cylinders 59 from expanding. Thus, the interference between these guide rails 52 and the side joggers 91 for the first pile 9 can be avoided. In detail, the positions of the guide rails 52 on the opposite sides are detected by the rotary encoder 72 and, if these positions are such that the guide rails 52 located there interfere with the side joggers 91, the control device 95 outputs nonoperating signals to the corresponding air cylinders 59.

The pulley 62 passed over by the wire 53 and the suction wheel 60 have their positions in the direction of sheet transport (i.e., their longitudinal positions) adjusted, in response to a change in the size (lengthwise size) of the sheet 8, by rotation of the threaded shafts 81*a* and 81*b*. Consequently, during the operation of the sheet guide device 50, the wire 53 always exists above the space between the first pile 9 and the second pile 10 over nearly the entire distance between these piles, so that the sheet 8 is guided smoothly.

In the present embodiment, as described above, there is provided the wire 53 moving between the guide position, at which the wire 53 guides the sheet 8 between the first pile 9 and the second pile 10, and the retreat position receding from the guide position. When in the aforementioned second state, the wire 53 has moved to the guide position. Not only above the first pile 9, but also between the first pile 9 and the second pile 10, therefore, the sheet 8 can be effectively guided, thus reliably preventing the fluttering and instability of the sheet 8 and achieving improved printing quality.

Moreover, one end of the wire 53 is urged in the direction of the retreat position, and the other end of the wire 53 is connected to and supported by the guide rail 52, and the wire 53 is moved, together with the guide rail 52, by the air cylinder 59. Thus, the wire 53 is caused to make a follow-up motion by a single drive source. Hence, cost reduction is achieved by simplification of the devices.

Also, the wire 53 is supported via the pulley 62 by the bracket 61 for supporting the suction wheel 60 and the sheet tail lay 90, which are provided for the second pile 10 and are movable in the direction of sheet transport in accordance with the size (in the lengthwise direction) of the sheet 8. Thus, during the operation of the sheet guide device 50, the wire 53 always exists above the space between the first pile 9 and the second pile 10 over nearly the entire distance between these piles, so that the sheet 8 is guided smoothly.

Furthermore, a plurality of the guide rails 52 and the air cylinders 59 are provided in the width direction of the sheet 8, and the control means is provided for making predetermined air cylinders 59 inoperable according to the size (widthwise size) of the sheet 8 to be transported. Thus, the guide rails 52 to be stretched out can be selected arbitrarily to become able to respond easily to a change in the size (widthwise size) of the sheet 8.

By rotating the threaded bars 70*a* to 70*b* and 75*a* to 75*c*, the lateral positions of the guide rail 52 and the wire 53 are adjusted in accordance with the size (widthwise size) of the sheet 8. Particularly when the size (widthwise size) of the sheet 8 is changed, for example, the opposite end portions of the sheet 8 in its width direction are guided unerringly. Thus, the sheet 8 is prevented from sagging, and is guided smoothly. In addition, the guide rail 52 and the wire 53 are moved unerringly to a position where they guide non-printed areas (margins) of the back of the sheet 8. Hence, the present sheet guide device 50 can be applied to a perfecting press or a printing press in which a sheet is transported with a printed surface directed downwards.

Moreover, the guide rails 52 are supported on a plurality of brackets 55 arranged in parallel in the width direction of the sheet 8; the brackets 55 are supported on the stays 54*a*, 54*b*, which span the frames 14, to be movable in the width direction of the sheet 8; a polarity of threaded bars 70*a* to 70*c* pierce through the brackets 55; and in accordance with the rotation of predetermined threaded bars of the plurality of threaded bars 70*a* to 70*c*, predetermined brackets screwed to the predetermined threaded bars among the brackets 55 can be moved, singly or in combination synchronously, in the width direction of the sheet 8. Thus, the lateral positions of the guide rails 52 can be effectively adjusted by as small a number of threaded bars 70*a* to 70*c* as possible, whereby simplification of the devices and cost reduction can be achieved.

Also, the guide rail 52 and the wire 53 are on nearly the same plane, and thus can guide the sheet 8 smoothly.

Also, the wire 53 is used for guiding, so that simplification of the devices and cost reduction are achieved.

Second Embodiment

Figure 7:
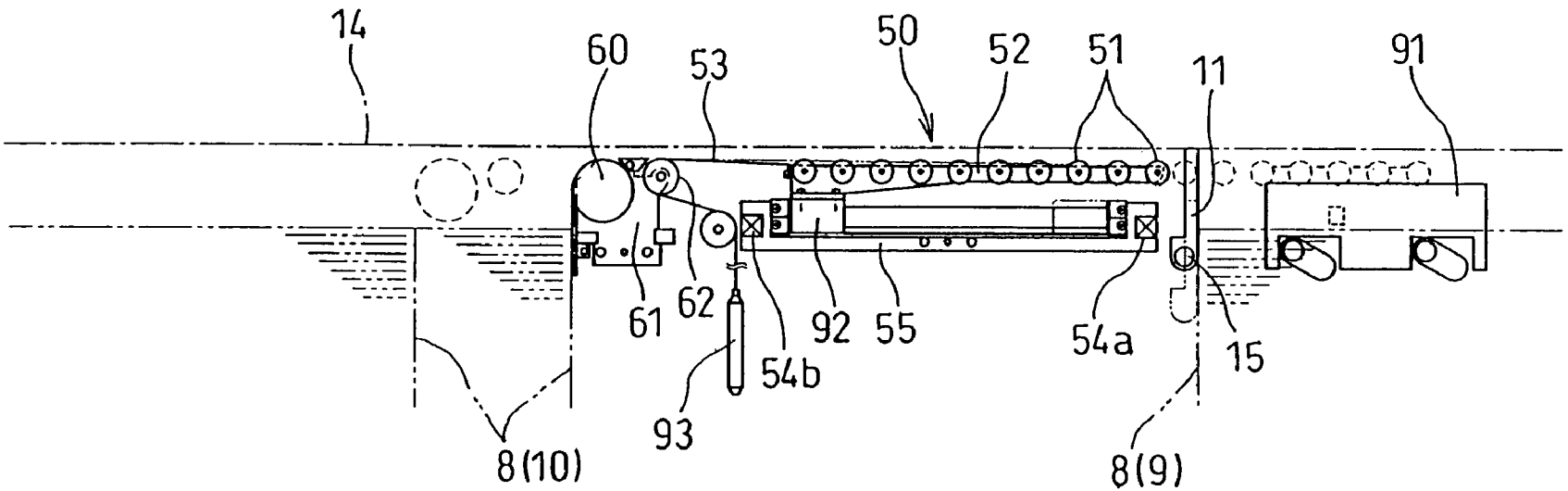
FIG. 7 is a side view of a sheet guide device showing a second embodiment of the present invention.

FIG. 7 is a side view of a sheet guide device showing a second embodiment of the present invention.

This embodiment is an embodiment in which a rodless cylinder 92 is used, instead of the air cylinder 59 in the preceding embodiment, as drive means for the guide rail 52, and a weight 93 is used, instead of the wire unit 63 in the preceding embodiment, as a means for imposing a constant load on the wire 53. This embodiment produces the same actions and effects as those obtained in the preceding embodiment. In the present embodiment, moreover, the sheet lay 11 is designed to lower, while the sheet lay 11 is designed to lie down in the preceding embodiment.

While the present invention has been described by the above embodiments, it is to be understood that the invention is not limited thereby, but may be varied or modified in many other ways. For example, in each of the above embodiments, the wire 53 is connected to the guide rail 52, and can be moved to the guide position and the retreat position by following the movement of the guide rail 52 in the sheet transport direction caused by the air cylinder 59. However, the wire 53 may be separated from the guide rail 52, and may be adapted to be moved independently by dedicated drive means. The lateral movement (movement in the width direction of the sheet 8) of the guide rail 52 and the suction wheel 60 is made by manual operation using the handle 71 or the like. However, a motor or the like may be mounted on the front end of each of the threaded shafts 70*a* to 70*c* and 75*a* to 75*c* so that the lateral movement of the guide rail 52 and the suction wheel 60 can be made by remote control and preset action, whereby the operating time can be shortened. In each of the embodiments, moreover, the suction wheel 60 and the sheet tail lay 90 are supported on the single bracket 61. However, the suction wheel 60 and the sheet tail lay 90 may be supported on separate brackets, and may be adapted to be moved individually in the direction of sheet transport. Furthermore, the suction wheel 60 is taken as an example of the position restraint member, but the sheet tail lay 90 may be used as the position restraint member. Such variations or modifications are not to be regarded as a departure from the spirit and scope of the invention, and all such variations and modifications as would be obvious to one skilled in the art are intended to be included within the scope of the appended claims.

What is claimed is:

1. A guide device for a sheet, comprising:

transport means for holding and transporting the sheet;

a first piling device and a second piling device for piling the sheet transported by said transport means;

switching means for switching between a first state, where the sheet held by said transport means is delivered to said first piling device, and a second state, where the sheet held by said transport means is passed above said first piling device and transported to a downstream side in a sheet transport direction;

at least one guide means, each guide means including, first guide means which, when in said second state, stretches out toward a side above said first piling device under an action of drive means to guide the sheet being passed, second guide means adapted to move between a guide position, at which said second guide means guides the sheet between said first piling device and said second piling device, such that the sheet is guided over substantially an entire distance between the first piling device and the second piling device, and a retreat position, at which said second guide means has receded from said guide position, said second guide means moves toward the guide position as the first guide means stretches out; and a position restraint member provided beside said second piling device and supported to be movable in the sheet transport direction in accordance with a size of the sheet, wherein when in said second state, said second guide means is at said guide position, and wherein said second guide means is supported via said position restraint member.

2. The guide device for a sheet according to claim 1, further comprising:

urging means that urges one end side of said second guide means in a direction of said retreat position, wherein other end side of said second guide means is supported by said first guide means, and said second guide means is moved together with said first guide means by said drive means.

3. The guide device for a sheet according to claim 2, wherein said at least one guide means includes a plurality of guide means, each guide means composed of said first guide means supported on a first bracket, and said second guide means supported on a second bracket that also supports a position restraint member, and wherein the plurality of guide means are provided in a width direction of the sheet.

4. The guide device for a sheet according to claim 3, wherein said position restraint member is a suction wheel capable of sucking the sheet.

5. The guide device for a sheet according to claim 1, wherein said position restraint member is a suction wheel capable of sucking the sheet.

6. The guide device for a sheet according to claim 1, wherein said first and second guide means have adjusting means for making adjustment in a width direction of the sheet.

7. The guide device for a sheet according to claim 1, wherein said first guide means and said second guide means are located on substantially a same plane.

8. The guide device for a sheet according to claim 1, wherein said second guide means is a wire.

9. The guide device for a sheet according to claim 8, wherein said wire is urged in a retreat direction by a drum rotationally urged in one direction by urging means.

10. The guide device for a sheet according to claim 8, wherein one end side of said wire is anchored to a weight.

11. The guide device for a sheet according to claim 3, wherein the position restraint member is supported by a single second guide means.

12. A guide device for a sheet, comprising:

transport means for holding and transporting the sheet;

a first piling device and a second piling device for piling the sheet transported by said transport means;

switching means for switching between a first state, where the sheet held by said transport means is delivered to said first piling device, and a second state, where the sheet held by said transport means is passed above said first piling device and transported to a downstream side in a sheet transport direction; and at least one guide means, each guide means including, first guide means which, when in said second state, stretches out toward a side above said first piling device under an action of drive means to guide the sheet being passed, and second guide means adapted to move between a guide position, at which said second guide means guides the sheet between said first piling device and said second piling device, such that the sheet is guided over substantially an entire distance between the first piling device and the second piling device, and a retreat position, at which said second guide means has receded from said guide position, said second guide means moves toward the guide position as the first guide means stretches out, wherein when in said second state, said second guide means is at said guide position, a plurality of said first guide means and said drive means are provided in a width direction of the sheet, and control means is provided for making said drive means inoperable in accordance with a width of the sheet to be transported.

13. The guide device for a sheet according to claim 12, further comprising:

urging means that urges one end side of said second guide means in a direction of said retreat position, wherein other end side of said second guide means is supported by said first guide means, and said second guide means is moved together with said first guide means by said drive means.

14. The guide device for a sheet according to claim 12, wherein said first and second guide means have adjusting means for making adjustment in a width direction of the sheet.

15. The guide device for a sheet according to claim 12, wherein said first guide means and said second guide means are located on substantially a same plane.

16. The guide device for a sheet according to claim 12, wherein said second guide means is a wire.

17. The guide device for a sheet according to claim 16, wherein said wire is urged in said retreat direction by a drum rotationally urged in one direction by urging means.

18. A guide device for a sheet, comprising:

transport means for holding and transporting the sheet;

a first piling device and a second piling device for piling the sheet transported by said transport means;

switching means for switching between a first state, where the sheet held by said transport means is delivered to said first piling device, and a second state, where the sheet held by said transport means is passed above said first piling device and transported to a downstream side in a sheet transport direction; and at least one guide means, each guide means including, first guide means which, when in said second state, stretches out toward a side above said first piling device under an action of drive means to guide the sheet being passed, and second guide means adapted to move between a guide position, at which said second guide means guides the sheet between said first piling device and said second piling device, such that the sheet is guided over substantially an entire distance between the first piling device and the second piling device, and a retreat position, at which said second guide means has receded from said guide position, said second guide means moves toward the guide position as the first guide means stretches out, wherein when in said second state, said second guide means is at said guide position, said first guide means is supported on each of a plurality of first brackets provided in parallel in a width direction of the sheet, said first brackets are supported to be movable in the width direction of the sheet on stays spanning frames, a plurality of threaded bars pierce through said first brackets, and in accordance with rotation of predetermined threaded bars of said plurality of threaded bars, predetermined first brackets screwed to said predetermined threaded bars among said first brackets can be moved, singly or in combination synchronously, in the width direction of the sheet.

19. The guide device for a sheet according to claim 18, further comprising:

urging means that urges one end side of said second guide means in a direction of said retreat position, wherein other end side of said second guide means is supported by said first guide means, and said second guide means is moved together with said first guide means by said drive means.

20. The guide device for a sheet according to claim 18, wherein said first guide means and said second guide means are located on substantially a same plane.

21. The guide device for a sheet according to claim 18, wherein said second guide means is a wire.

22. The guide device for a sheet according to claim 21, wherein said wire is urged in said retreat direction by a drum rotationally urged in one direction by urging means.

23. A guide device for a sheet, comprising:

transport means for holding and transporting the sheet;

a first piling device and a second piling device for piling the sheet transported by said transport means;

switching means for switching between a first state, where the sheet held by said transport means is delivered to said first piling device, and a second state, where the sheet held by said transport means is passed above said first piling device and transported to a downstream side in a sheet transport direction; and at least one guide means, each guide means including, first guide means which, when in said second state, stretches out toward a side above said first piling device under an action of drive means to guide the sheet being passed, and second guide means adapted to move between a guide position, at which said second guide means guides the sheet between said first piling device and said second piling device, such that the sheet is guided over substantially an entire distance between the first piling device and the second piling device, and a retreat position, at which said second guide means has receded from said guide position, said second guide means moves toward the guide position as the first guide means stretches out, wherein when in said second state, said second guide means is at said guide position, said second guide means is supported on each of a plurality of second brackets provided in parallel in a width direction of the sheet for supporting a position restraint member, said second brackets are supported to be movable in the width direction of the sheet on a support shaft which spans frames and which is movable in the sheet transport direction, a plurality of threaded bars pierce through said second brackets, and in accordance with rotation of predetermined threaded bars of said plurality of threaded bars, predetermined second brackets screwed to said predetermined threaded bars among said second brackets can be moved, singly or in combination synchronously, in the width direction of the sheet.

24. The guide device for a sheet according to claim 23, wherein said position restraint member is a suction wheel capable of sucking the sheet.

25. The guide device for a sheet according to claim 23, further comprising:

urging means that urges one end side of said second guide means in a direction of said retreat position, wherein other end side of said second guide means is supported by said first guide means, and said second guide means is moved together with said first guide means by said drive means.

26. The guide device for a sheet according to claim 23, wherein said first guide means and said second guide means are located on substantially a same plane.

27. The guide device for a sheet according to claim 23, wherein said second guide means is a wire.

28. The guide device for a sheet according to claim 27, wherein said wire is urged in said retreat direction by a drum rotationally urged in one direction by urging means.

29. A guide device for a sheet, comprising:

transport means for holding and transporting the sheet;

a first piling device and a second piling device for piling the sheet transported by said transport means;

switching means for switching between a first state, where the sheet held by said transport means is delivered to said first piling device, and a second state, where the sheet held by said transport means is passed above said first piling device and transported to a downstream side in a sheet transport direction;

at least one guide means, each guide means including, first guide means which, when in said second state, stretches out toward a side above said first piling device under an action of drive means to guide the sheet being passed, and second guide means adapted to move between a guide position, at which said second guide means guides the sheet between said first piling device and said second piling device, such that the sheet is guided over substantially an entire distance between the first piling device and the second piling device, and a retreat position, at which said second guide means has receded from said guide position, said second guide means moves toward the guide position as the first guide means stretches out; and urging means that urges one end side of said second guide means in a direction of said retreat position, wherein when in said second state, said second guide means is at said guide position, other end side of said second guide means is supported by said first guide means, said second guide means is moved together with said first guide means by said drive means, a position restraint member is provided beside the second piling device and supported so as to be movable in the sheet transport direction in accordance with a size of the sheet, wherein said second guide means is supported on a second bracket that also supports said position restraint member.

30. The guide device for a sheet according to claim 29, wherein said position restraint member is a suction wheel capable of sucking the sheet.

31. The guide device for a sheet according to claim 29, wherein the position restraint member is supported by a single second guide means.

* * * * *